US011976655B2

(12) United States Patent
Ye et al.

(10) Patent No.: US 11,976,655 B2
(45) Date of Patent: May 7, 2024

(54) SCROLL COMPRESSOR

(71) Applicant: Emerson Climate Technologies (Suzhou) Co., Ltd., Jiangsu (CN)

(72) Inventors: Tao Ye, Jiangsu (CN); Qingfeng Sun, Jiangsu (CN); Meng Wang, Jiangsu (CN); Dang Zeng, Jiangsu (CN)

(73) Assignee: Copeland Climate Technologies (Suzhou) Co. Ltd., Jiangsu (CN)

( * ) Notice: Subject to any disclaimer, the term of this patent is extended or adjusted under 35 U.S.C. 154(b) by 153 days.

(21) Appl. No.: 16/304,577

(22) PCT Filed: May 27, 2017

(86) PCT No.: PCT/CN2017/086276
§ 371 (c)(1),
(2) Date: Nov. 26, 2018

(87) PCT Pub. No.: WO2017/202385
PCT Pub. Date: Nov. 30, 2017

(65) Prior Publication Data

US 2019/0301462 A1 Oct. 3, 2019

(30) Foreign Application Priority Data

May 27, 2016 (CN) ..... 201620508711.4
May 27, 2016 (CN) ..... 291610363334.4

(51) Int. Cl.
*F04C 18/02* (2006.01)
*F04C 27/00* (2006.01)

(52) U.S. Cl.
CPC ..... *F04C 18/0284* (2013.01); *F04C 18/0215* (2013.01); *F04C 18/0269* (2013.01); *F04C 27/00* (2013.01); *F04C 27/005* (2013.01)

(58) Field of Classification Search
CPC .... F04C 18/0215–0223; F04C 18/0269; F04C 27/00; F04C 27/005; F04C 18/0284
(Continued)

(56) References Cited

U.S. PATENT DOCUMENTS 5,545,020 A * 8/1996 Fukanuma ..... F04C 27/005 418/55.4
5,702,241 A * 12/1997 Matsumoto ..... F04C 27/005 418/142

(Continued)

FOREIGN PATENT DOCUMENTS

CN 1177683 A 4/1998
CN 1782398 A 6/2006

(Continued)

OTHER PUBLICATIONS

Extended European Search Report regarding Application No. 17802231.5 dated Nov. 29, 2019.

(Continued)

*Primary Examiner* — Alexander B Comley
(74) *Attorney, Agent, or Firm* — Harness, Dickey & Pierce, P.L.C.

(57) ABSTRACT

A scroll compressor includes fixed and orbiting scrolls. The fixed scroll includes a fixed scroll end plate and a spiral fixed wrap extending from the end plate. The orbiting scroll includes an orbiting scroll end plate and an orbiting wrap extending from the end plate and engaging with the fixed wrap to form compression chambers. The fixed wrap includes a first fixed wrap portion on a radially outer side and a second fixed wrap portion on a radially inner side. The first fixed wrap portion is periodically covered by the orbiting scroll end plate and the second fixed wrap portion is always covered by the orbiting scroll end plate while the scroll compressor is operating. A sealing member is provided on one of the first fixed wrap portion and a first (Continued)

covering portion of the orbiting scroll end plate corresponding to the first fixed wrap portion.

9 Claims, 7 Drawing Sheets

(58) Field of Classification Search
USPC ..... 417/410.5
See application file for complete search history.

(56) References Cited

U.S. PATENT DOCUMENTS

| | | | | |
|---|---|---|---|---|
| 6,659,745 | B2 * | 12/2003 | Fujita | F04C 18/0276 418/55.2 |
| 6,887,052 | B1 | 5/2005 | Bush et al. | |
| 7,052,255 | B2 * | 5/2006 | Hong | F04C 23/001 417/310 |
| 8,157,550 | B2 | 4/2012 | Kudo | |
| 2010/0086427 | A1 | 4/2010 | Kudo | |
| 2013/0209305 | A1 | 8/2013 | Takei | |
| 2016/0238007 | A1 * | 8/2016 | Kanemitsu | F04C 18/0284 |

FOREIGN PATENT DOCUMENTS

| | | | | |
|---|---|---|---|---|
| CN | 1910364 | A | 2/2007 | |
| CN | 201265526 | Y | 7/2009 | |
| CN | 101529095 | A | 9/2009 | |
| CN | 202149031 | U | 2/2012 | |
| CN | 102985696 | A | 3/2013 | |
| CN | 104712556 | A | 6/2015 | |
| CN | 104847660 | A | 8/2015 | |
| CN | 205117718 | U | 3/2016 | |
| CN | 205779690 | U | 12/2016 | |
| EP | 0743454 | A2 * | 11/1996 | F04C 27/005 |
| EP | 2589808 | A1 | 5/2013 | |
| JP | 2007051558 | A | 3/2007 | |
| JP | 5480994 | B1 | 4/2014 | |

OTHER PUBLICATIONS

International Search Report for PCT/CN2017/086276, ISA/CN, Haidian District, Beijing, dated Aug. 24, 2017.
Written Opinion of the ISA for PCT/CN2017/086276, ISA/CN, Haidian District, Beijing, dated Aug. 24, 2017.
First Chinese Office Action regarding Chinese Application No. 201610363334.4 dated Dec. 28, 2018. Translation provided by globaldossier.uspto.gov.

* cited by examiner

SCROLL COMPRESSOR

This application is the national phase of International Application No. PCT/CN2017/086276 titled "VORTEX COMPRESSOR" and filed on May 27, 2017, which claims the priority to Chinese Patent Applications Nos. CN201610363334.4 and CN201620508711.4, filed with the Chinese Patent Office on May 27, 2016. The entire disclosures of these applications are incorporated herein by reference.

FIELD OF THE INVENTION

The present disclosure relates to a scroll compressor.

BACKGROUND OF THE INVENTION

The contents in this section only provide background information relating to the present disclosure, which may not necessarily constitute the prior art.

A scroll compressor typically includes a compression mechanism, a drive shaft and a motor. The compression mechanism includes a non-orbiting scroll and an orbiting scroll. The non-orbiting scroll is mounted to a main bearing housing in such a way to be axially floatable but not rotatable, or is fixedly mounted to the main bearing housing. The orbiting scroll is inserted in the non-orbiting scroll, and is driven by the drive shaft to orbit with respect to the non-orbiting scroll (that is, the central axis of the orbiting scroll rotates with respect to the central axis of the non-orbiting scroll, but the orbiting scroll may not rotate about its own axis), such that vanes (or wraps) of the orbiting scroll and non-orbiting scroll engage with each other to form a series of compression chambers with gradually decreased volumes for compressing the working fluid (e.g., refrigerant).

Due to some factors such as the mounting structure, back pressure structure, floating structure, etc., the design of the profile of the vanes of the orbiting scroll and the non-orbiting scroll is limited, i.e., the radial utilizable space of the orbiting scroll and the non-orbiting scroll is limited so that the capacity of the compressor is limited.

Accordingly, there is a need in the art for a compressor having an improved vane design such that the radial space of the compression mechanism can be fully utilized to increase capacity and have a good seal.

SUMMARY OF THE INVENTION

An object of the present disclosure is to provide a compressor having an improved wrap structure such that a radial space of a compression mechanism can be fully utilized to increase capacity and have a good seal.

Another object of the present disclosure is to provide a scroll compressor that reduces wear between a wrap and an end plate.

One or more of the above objects can be achieved by a scroll compressor which includes a non-orbiting scroll and an orbiting scroll, wherein the non-orbiting scroll includes a non-orbiting scroll end plate and a spiral non-orbiting wrap extending from the non-orbiting scroll end plate; and the orbiting scroll includes an orbiting scroll end plate and an orbiting wrap extending from the orbiting scroll end plate and meshingly engaging with the non-orbiting wrap to form compression chambers. The non-orbiting wrap includes a first non-orbiting wrap portion at a radially outer side and a second non-orbiting wrap portion at a radially inner side, the first non-orbiting wrap portion being periodically covered by the orbiting scroll end plate during operation of the scroll compressor, and the second non-orbiting wrap portion being always covered by the orbiting scroll end plate during operation of the scroll compressor. A sealing device is provided in one of the first non-orbiting wrap portion and a first covering portion, corresponding to the first non-orbiting wrap portion, of the orbiting scroll end plate.

A scroll compressor according to the present disclosure has an improved wrap structure. In particular, the non-orbiting wrap of the non-orbiting scroll extends close to the mounting portion, thereby fully utilizing the radial space of the non-orbiting scroll, so that the capacity of the compressor can be increased. Further, since the sealing device is provided between the first non-orbiting wrap portion and the first covering portion, it is possible to satisfactorily prevent leakage of gas in the compression chamber, thereby improving the operating efficiency of the compressor.

Preferably, the sealing device includes a protrusion protruding from one of an end surface of the first non-orbiting wrap portion and the first covering portion, and a predetermined gap is formed between the protrusion and the other one of the end surface of the first non-orbiting wrap portion and the first covering portion. In this structure, the gap between the protrusion and the first non-orbiting wrap portion or between the protrusion and the first covering portion may be formed by setting the height of the protrusion, thereby, the oil seal can be achieved.

Preferably, the protrusion is integrally formed with one of the end surface of the first non-orbiting wrap portion and the first covering portion. Alternatively, the protrusion is a coating applied to the one of the end surface of the first non-orbiting wrap portion and the first covering portion. The protrusion may be a wear resistant layer or a corrosion resistant layer. For example, depending on the application conditions and application requirements, the coating can have different properties such as wear resistance, compatibility with lubricating oils, and the like.

Preferably, the sealing device includes a first sealing member provided on an end surface of the first non-orbiting wrap portion.

Preferably, a second sealing member is provided on an end surface of the second non-orbiting wrap portion, the first sealing member has a height less than the height of the second sealing member such that a predetermined gap is formed between the first sealing member and the first covering portion during operation of the scroll compressor. With such a structure, the wear of the first non-orbiting wrap portion can be reduced compared with that of the second non-orbiting wrap portion or can be completely avoided.

Preferably, a first groove configured to accommodate the first sealing member is provided on the end surface of the first non-orbiting wrap portion, and a second sealing member and a second groove configured to accommodate the second sealing member are provided on the end surface of the second non-orbiting wrap portion.

Preferably, the first covering portion includes a thickness reduced region, and a predetermined gap is formed between the first non-orbiting wrap portion and the thickness reduced region during operation of the scroll compressor.

The thickness reduced region of the first covering portion may have a constant thickness or a varied thickness.

The second sealing member may be continuous with the first sealing member or may be separate from the first sealing member. The difference between the height of the first sealing member and the height of the second sealing member may be between 0 μm and 100 μm. The height of the first sealing member and/or the height of the second sealing member may be constant or varied.

The first groove may be continuous with the second groove or may be separate from the second groove. The depth of the first groove and/or the depth of the second groove may be constant or varied.

Preferably, the thickness of the thickness reduced region of the first covering portion is less than the thickness of other parts of the first covering portion by 0 μm to 100 μm.

Preferably, the predetermined gap allows an oil seal to be achieved between the first non-orbiting wrap portion and the first covering portion. Preferably, the predetermined gap is between 0 μm and 30 μm.

Other aspects and advantages of the present application will be apparent from the description of the principle of the present application made exemplarily hereinafter with reference to the drawings.

BRIEF DESCRIPTION OF THE DRAWINGS

The features and advantages of one or more embodiments of the present disclosure will become more readily understood from the following description made with reference to the accompanying drawings in which.

DETAILED DESCRIPTION

The following description of various embodiments of the present disclosure is merely exemplary and is by no means intended to limit the present disclosure, its application or usage. Throughout the drawings, the like reference signs are used to indicate the like elements and thus the description of configurations of the like elements will not be repeated.

The orientation words referred to herein, such as "up, down, left, and right," refer to the orientations observed from the drawings, unless otherwise explicitly stated herein.

Figure 1:
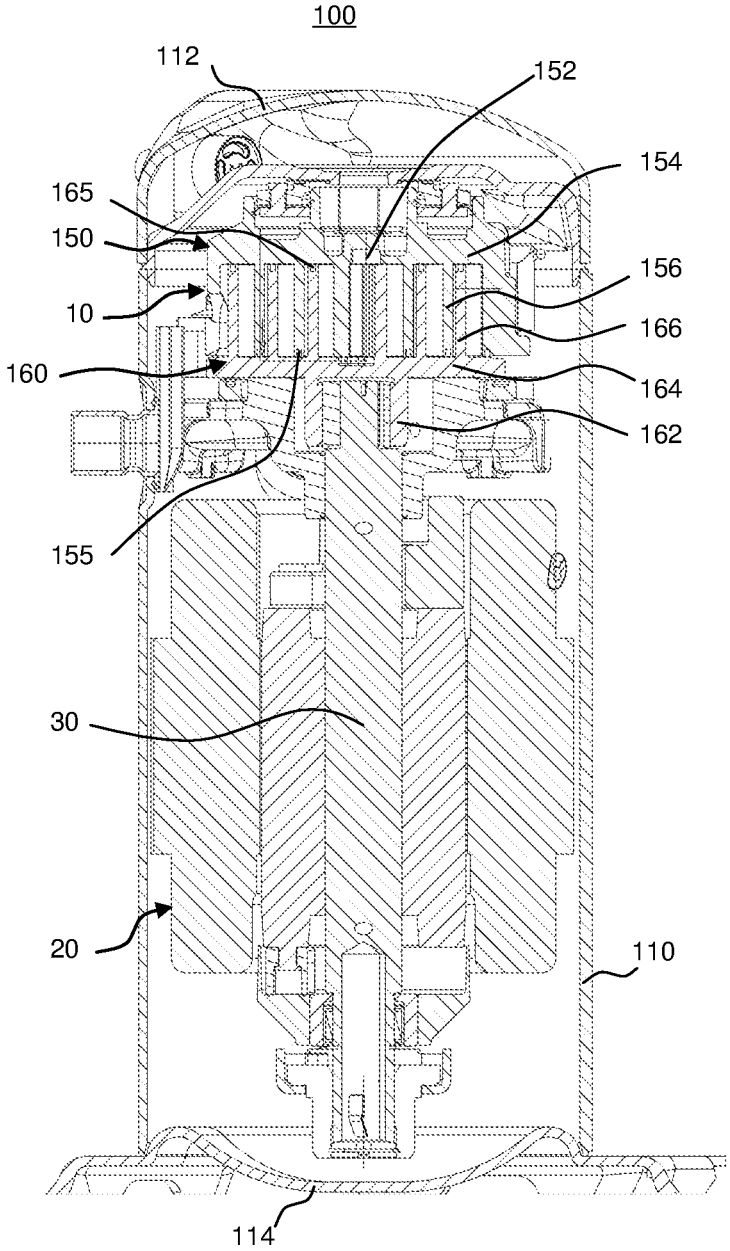
FIG. 1 is a schematic longitudinal sectional view of a scroll compressor.

The overall configuration and operating principle of the scroll compressor will be described with reference to FIG. 1. As shown in FIG. 1, a scroll compressor 100 (sometimes referred to as a compressor hereinafter) generally includes a housing 110, a top cover 112 arranged at one end of the housing 110, and a bottom cover 114 arranged at the other end of the housing 110. A compression mechanism 10, a drive shaft 30 and a motor 20 are arranged in the housing 110. The motor 20 is configured to rotate the drive shaft 30, and then the rotation of the drive shaft 30 causes the orbiting scroll 160 to orbit with respect to the non-orbiting scroll 150 (i.e., the central axis of the orbiting scroll 160 rotates about the central axis of the non-orbiting scroll 150, but the orbiting scroll 160 does not rotate about its own central axis), thereby achieving compression of the fluid.

Figure 2:
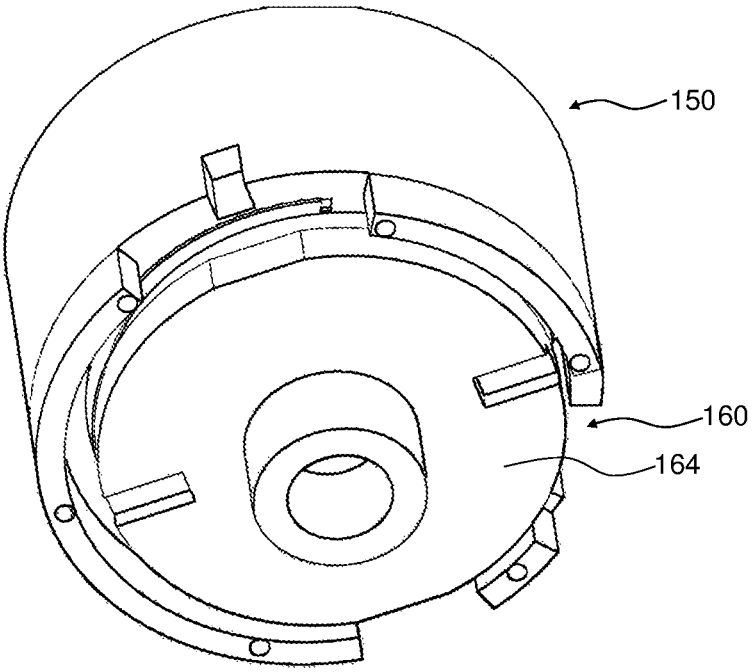
FIG. 2 is a schematic perspective view of a compression mechanism of a scroll compressor.

With reference to FIG. 2, the compression mechanism 10 includes a non-orbiting scroll 150 and an orbiting scroll 160, and the orbiting scroll 160 is inserted within the non-orbiting scroll 150. The orbiting scroll 160 includes an end plate 164, a hub 162 formed at one side of the end plate, and a spiral wrap (orbiting wrap) 166 formed at another side of the end plate. The non-orbiting scroll 150 includes an end plate 154, a spiral wrap (non-orbiting wrap) 156 formed at one side of the end plate, and a discharge port 152 formed at a substantially central position of the end plate. A series of compression chambers with volumes gradually decreased from a radially outer side to a radially inner side are formed between the spiral wrap 156 of the non-orbiting scroll 150 and the spiral wrap 166 of the orbiting scroll 160. Specifically, the radially outermost compression chamber is at a suction pressure, and the radially innermost compression chamber is at a discharge pressure. Intermediate compression chambers are at a pressure between the suction pressure and the discharge pressure, and are therefore also referred to as a medium pressure chamber.

Figure 3:
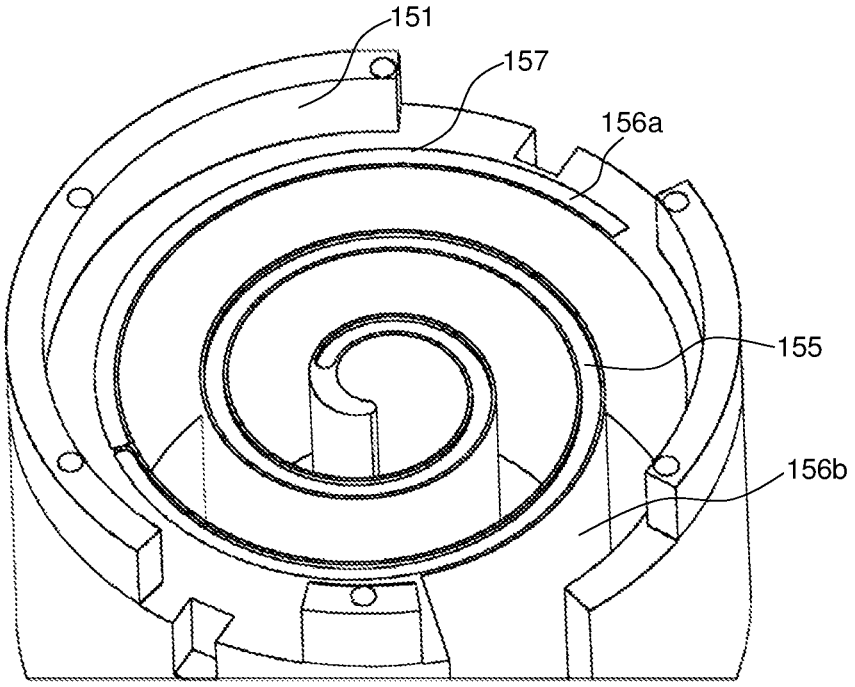
FIG. 3 is a schematic perspective view of a non-orbiting scroll according to an embodiment of the present disclosure.

Referring to FIG. 3, a schematic perspective view of a non-orbiting scroll 150 according to an embodiment of the present disclosure is shown. As shown in FIG. 3, the non-orbiting scroll 150 includes a mounting portion 151 along its periphery. The non-orbiting scroll 150 may be mounted to the main bearing housing through the mounting portion 151 or directly fixedly connected to the compressor housing 110. The non-orbiting wrap 156 of the non-orbiting scroll 150 extends in a spiral form from an approximately central portion of the non-orbiting scroll toward the radially outer side to a position close to the mounting portion 151.

Since the non-orbiting wrap 156 extends as close as possible to the mounting portion 151, during operation of the compressor 100 according to the present disclosure, when the orbiting scroll 160 (particularly, the end plate 164) moves away from the radially outmost portion of the non-orbiting wrap 156 of the non-orbiting scroll 150, the radially outmost portion may not be covered by the end plate 164 of the orbiting scroll 160, i.e., be exposed to the outside; and when the orbiting scroll 160 (in particular, the end plate 164) moves towards the radially outmost portion of the non-orbiting wrap 156, the radially outmost portion is gradually covered by the end plate 164 of the orbiting scroll 160, till the non-orbiting wrap 156 is completely covered by the end plate 164 of the orbiting scroll 160.

Figure 4:
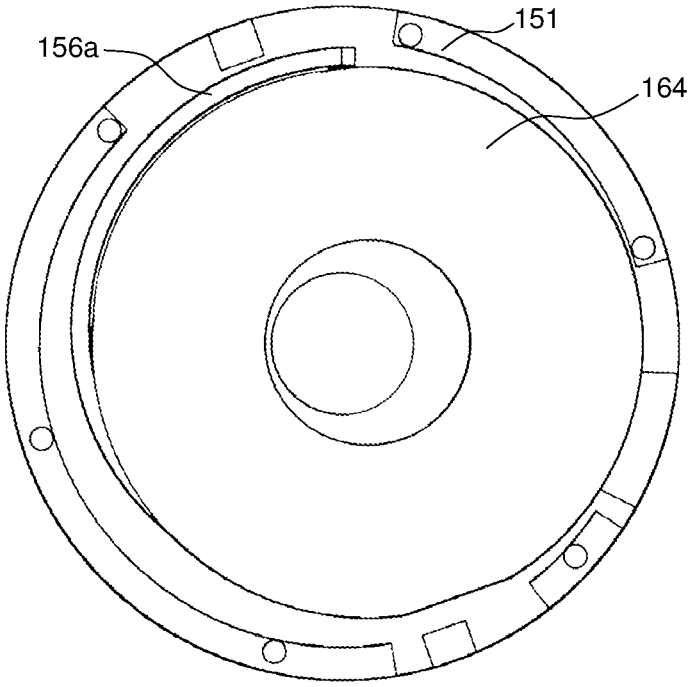
FIG. 4 is a bottom view of the compression mechanism in FIG. 2 in a first operating state in which a portion of a non-orbiting wrap of the non-orbiting scroll is not covered by an orbiting scroll end plate.
Figure 5:
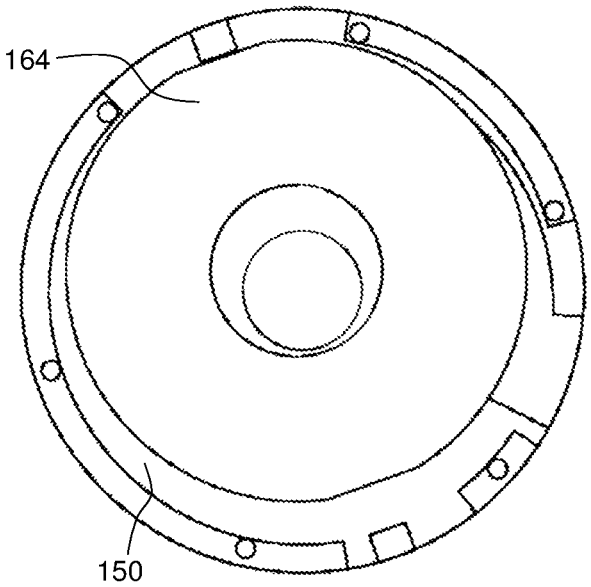
FIG. 5 is a bottom view of the compression mechanism in FIG. 2 in a second operating state in which the non-orbiting wrap of the non-orbiting scroll is completely covered by the orbiting scroll end plate.

FIGS. 4 and 5 show schematic bottom views of the compression mechanism in different states during operation of the compressor. In the state shown in FIG. 4 (first operating state), the radially outermost portion of the non-orbiting wrap 156 is not covered by the orbiting scroll end plate 164; and in the state shown in FIG. 5 (second operating state), the non-orbiting wrap 156 is completely covered by the orbiting scroll end plate 164.

For convenience of description, the radially outermost portion periodically exposed to the outside of the non-orbiting wrap 156 is referred to as a first non-orbiting wrap portion 156*a*; and the portion, always covered by the orbiting scroll end plate 164, of the non-orbiting wrap 156 is referred to as a second non-orbiting wrap portion 156*b*; and a portion, corresponding to the first non-orbiting wrap portion 156*a*, of the end plate 164 of the orbiting scroll 160 is referred to as a first covering portion 164*a*. Closed compression chambers are formed when the first non-orbiting wrap portion 156*a* is covered by the first covering portion 164*a*. With the above structure in the compressor 100 according to the present disclosure, a radial space of the non-orbiting wrap 156 (compression mechanism) is fully utilized, thereby increasing the capacity of the compressor 100.

The unfolding angle A (radian) of the radially outermost end of the second non-orbiting wrap portion 156*b* of the non-orbiting scroll 150 can be obtained by the following formula. $A=((D/2-Ror)^2-Rg^2)^{0.5}/Rg$, wherein D is an outer diameter of the end plate 164 of the orbiting scroll 160, and Ror is the radius of gyration of the scroll compressor, and Rg is the radius of the base circle of the wrap. The maximum radius of the radially outermost end of the second non-orbiting wrap portion 156*b* is D/2−Ror, and the corresponding maximum radius in an unfolding state is $((D/2-Ror)^2-Rg^2)^{0.5}$.

Generally, in order to prevent gas in the compression chambers from leaking to the outside of the compression mechanism and/or to prevent the gas in one compression chamber from leaking into other compression chambers, sealing devices may be provided between the orbiting wrap and the non-orbiting scroll end plate and between the non-orbiting wrap and the orbiting scroll end plate. In another embodiment of the present disclosure, a sealing device may be arranged at least between the first non-orbiting wrap portion 156*a* of the non-orbiting scroll 150 and the first covering portion 164*a*.

Figure 6:
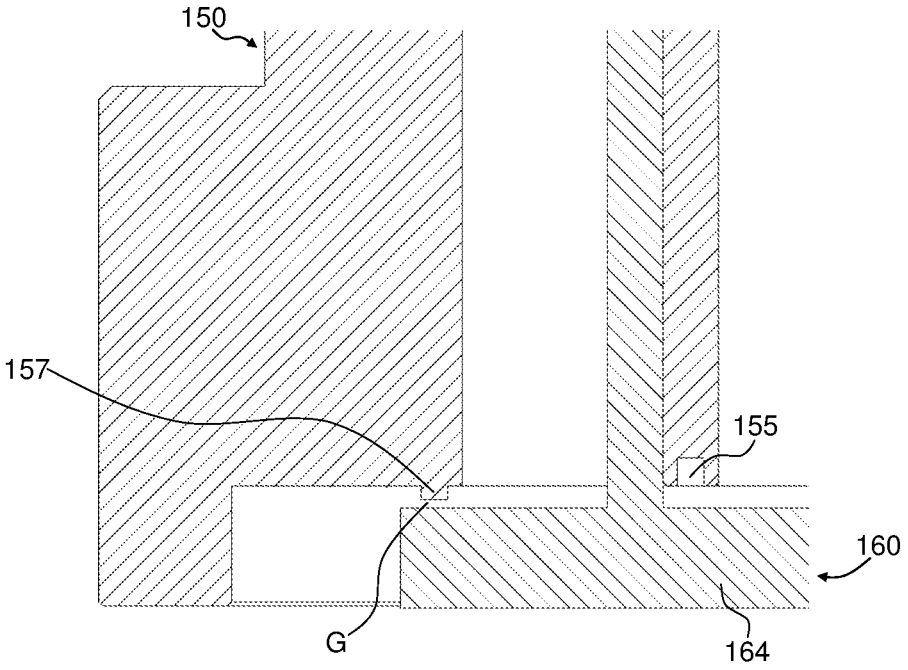
FIG. 6 is a schematic partially sectional view of FIG. 3.

FIG. 6 is a schematic partially sectional view of the compression mechanism 10, showing an embodiment of the sealing device according to the present disclosure. Referring to FIGS. 3 and 6, a protrusion 157 may be provided on an end surface of the first non-orbiting wrap portion 156*a*. In one example, the protrusion 157 may protrude from the end surface of the first non-orbiting wrap portion 156*a* and be integrally formed with the first non-orbiting wrap portion 156*a*. As shown in FIG. 6, a gap G is formed between the protrusion 157 and the end plate 164 of the orbiting scroll 160 (particularly, the first covering portion 164*a*). The gap G is set such that a seal between the protrusion 157 and the end plate 164 of the orbiting scroll 160 can be achieved by lubricating oil during normal operation of the compressor. In another example, the protrusion 157 may be formed of a coating applied on the end surface of the first non-orbiting wrap portion 156*a*. It should be understood that the protrusion 157 may also be arranged on the first covering portion 164*a* of the end plate 164 of the orbiting scroll 160, where appropriate. The protrusion 157 may be a wear resistant layer or may be a corrosion resistant layer depending on the application environment.

Figure 10:
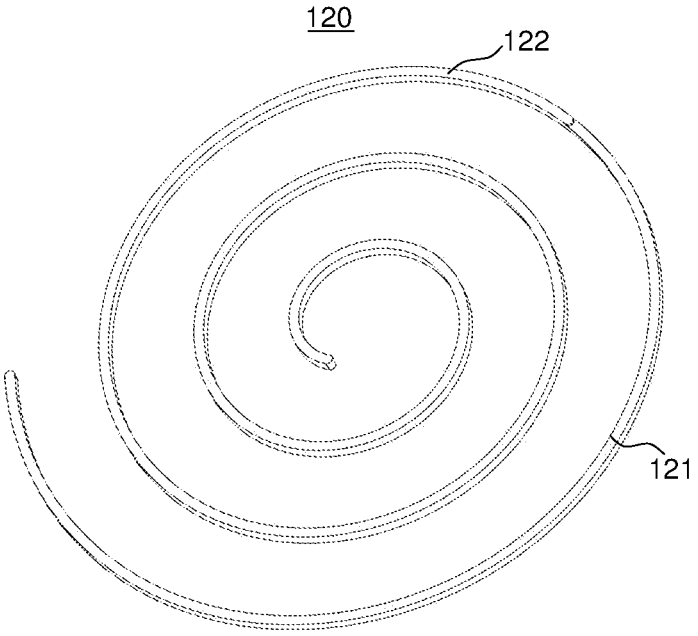
FIG. 10 is a schematic view of a sealing strip mounted to an end surface of the non-orbiting wrap according to an embodiment of the present disclosure.

As shown in FIG. 10, sealing strips (or referred to as sealing members) 120 may be provided on partial or entire of the end surfaces of the orbiting wrap 166 and the non-orbiting wrap 156. For example, the sealing strip 120 can be a PTFE sealing washer. In another example, a groove 165 (as shown in FIG. 1) configured to accommodate the sealing strip 120 may be provided on the end surface of the orbiting wrap 166, and a groove 155 (as shown in FIGS. 1 and 3) configured to accommodate the sealing strip 120 may be provided on the end surface of the non-orbiting wrap 156.

In another embodiment of the sealing device, a sealing strip may be provided on the first non-orbiting wrap portion 156*a* to achieve a seal between the first non-orbiting wrap portion 156*a* and the first covering portion 164*a*. During operation of the compressor 100, since the first non-orbiting wrap portion 156*a* is periodically covered by the orbiting scroll end plate 164 and exposed to the outside, that is, the first non-orbiting wrap portion 156*a* periodically slides in and out with respect to the orbiting scroll end plate 164, the sealing member (e.g., the sealing strip 120) arranged between the first non-orbiting wrap portion 156*a* and the orbiting scroll end plate 164 may itself be rapidly worn, or result in rapid wear of the orbiting scroll end plate 164.

In order to reduce or eliminate wear between the first non-orbiting wrap portion 156*a* and the orbiting scroll end plate 164, a sealing strip (the first sealing member or the first sealing strip) 121 in the first non-orbiting wrap portion 156*a* may have a height less than the height of a sealing strip (the second sealing member or the second sealing strip) 122 in the second non-orbiting portion 156*b*, as shown in FIG. 10. The difference between the height of the first sealing strip 121 and the height of the second sealing strip 122 may be in a range of 0 mm to 0.1 mm. It should be understood that, the first sealing strip 121 may have a constant height or a varied height.

Figure 11:
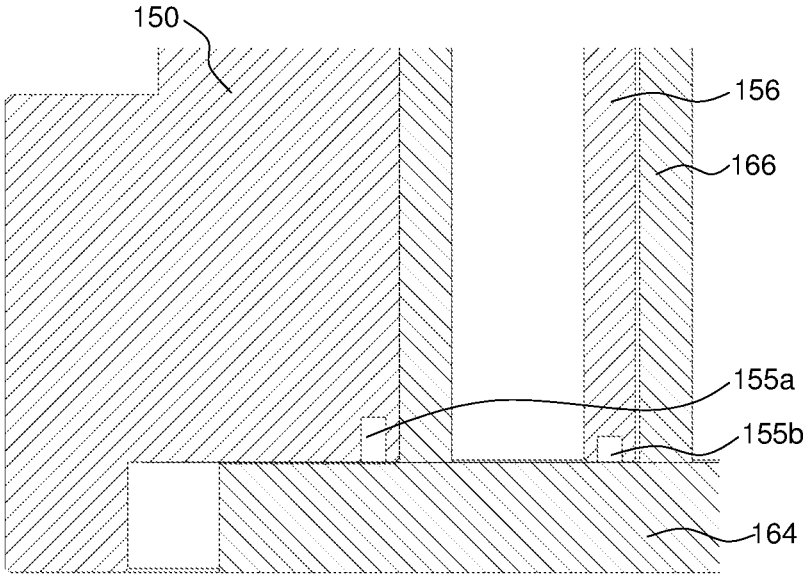
FIG. 11 is a schematic partially sectional view of a compression mechanism according to an embodiment of the present disclosure, showing that grooves for mounting sealing strips have different depths.
Figure 12A:
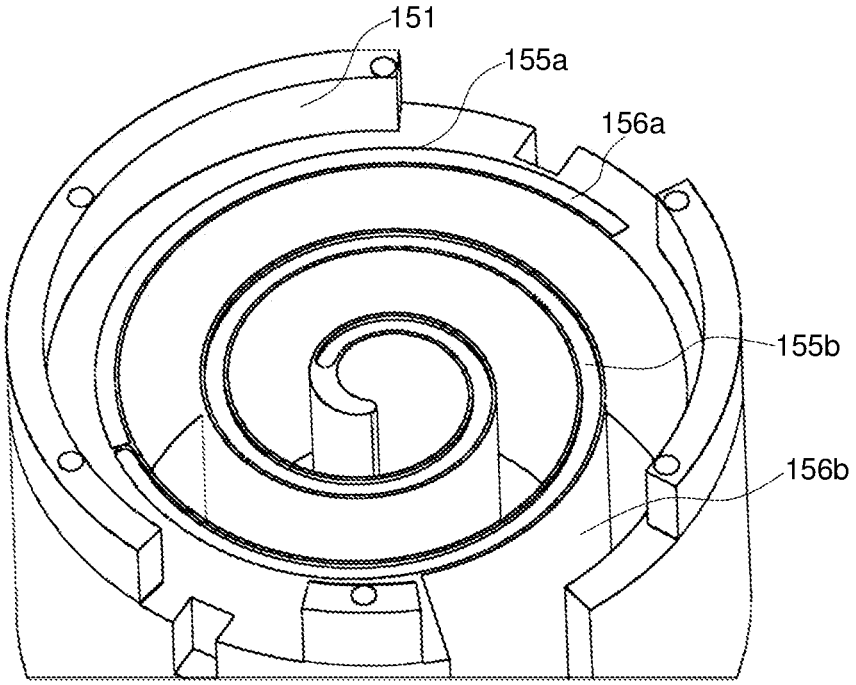
FIG. 12A is a perspective view of another non-orbiting scroll.
Figure 12B:
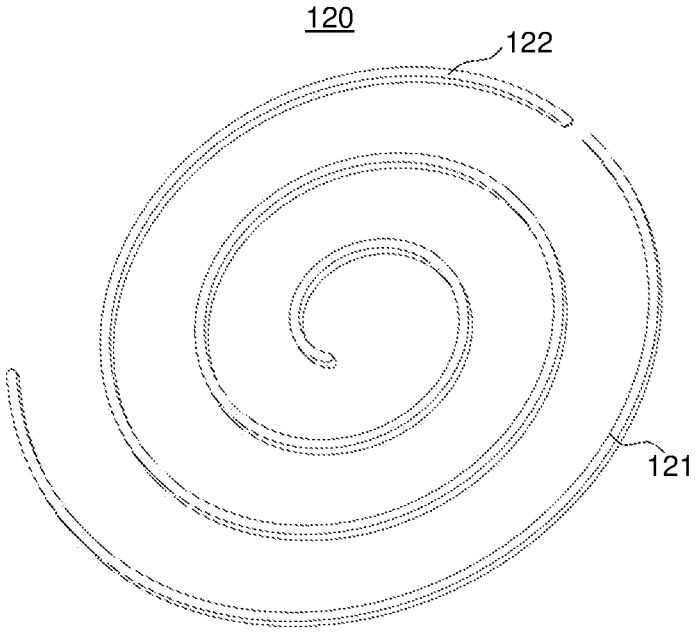
FIG. 12B is a perspective view of another sealing strip.

In the example shown in FIG. 10, the first sealing strip 121 and the second sealing strip 122 are integrally formed. However, it should be understood that, in other examples, the first sealing strip 121 and the second sealing strip 122 may be separately formed. In another example, as shown in FIG. 11, in the case where the first sealing strip 121 and the second sealing strip 122 have the same height, the first groove 155*a* configured to accommodate the first sealing strip 121 may have a depth greater than the depth of the second groove 155*b* configured to accommodate the second sealing strip 122. The difference between the depth of the first groove 155*a* and the depth of the second groove 155*b* may be in a range of 0 mm to 0.1 mm. It should be understood that the first groove 155*a* may have a constant depth or a varied depth. The wear between the first non-orbiting wrap portion 156*a* and the first covering portion 164*a* can be reduced or avoided by lowering the height of the first sealing strip 121 or by increasing the depth of the first groove. For example, a predetermined gap may be formed between the sealing member and the first covering portion 164*a* by lowering the height of the first sealing strip 121 or by increasing the depth of the first groove, so that the issue of wear between the sealing member and the first covering portion 164*a* can be avoided, and oil seal may also be achieved.

Figure 7:
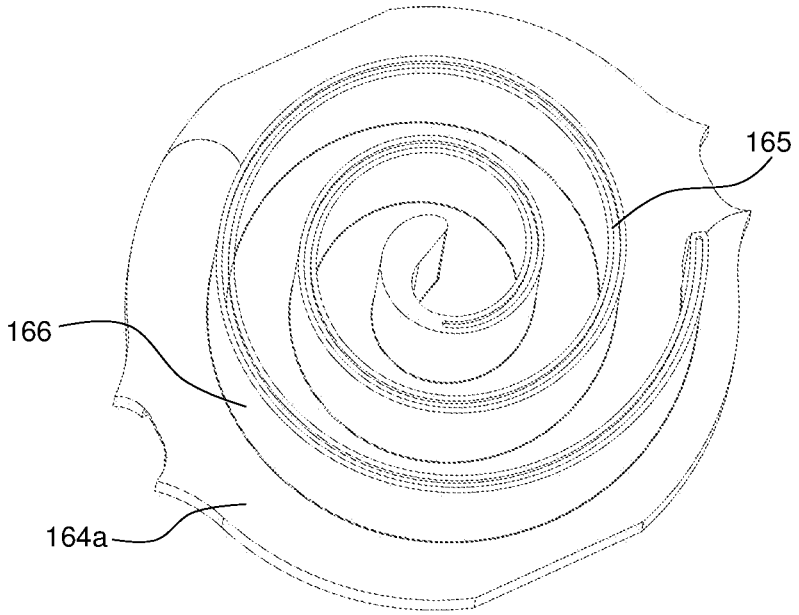
FIG. 7 is a schematic perspective view of an orbiting scroll according to another embodiment of the present disclosure.
Figure 8:
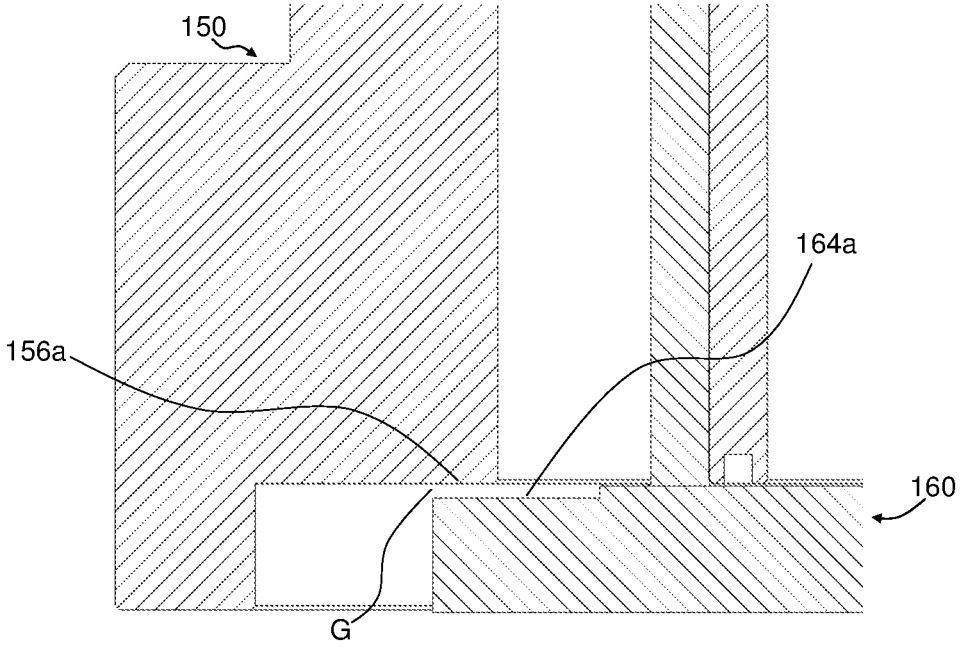
FIG. 8 is a schematic partially sectional view of FIG. 7.
Figure 9:
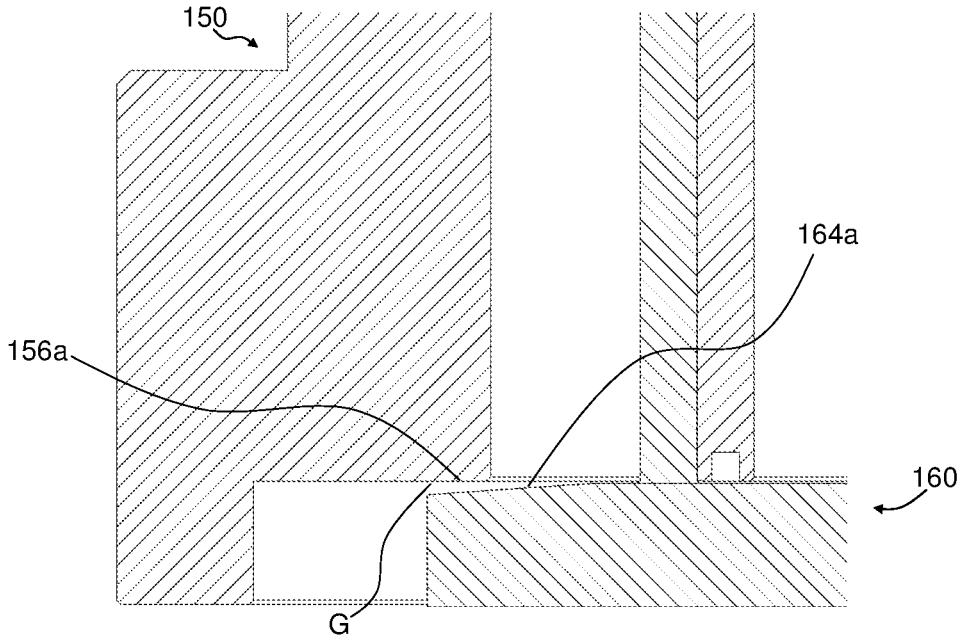
FIG. 9 is a schematic sectional view of a variation of FIG. 8.

In another embodiment, the first covering portion 164*a* of the orbiting scroll end plate 164 may have a thickness reduced region. Specifically, the thickness reduced region may have a thickness less than the thickness of other parts of the orbiting scroll end plate 164, as shown in FIG. 7. The thickness reduced region may be a partial region of the first covering portion 164*a* or may be the entire region of the first covering portion 164*a*. The difference between the thickness of the thickness reduced region and the thickness of other portions of the orbiting scroll end plate 164 may be in a range of 0 mm to 0.1 mm (100 μm), thereby reducing or avoiding the wear between the first non-orbiting wrap portion 156*a* and the first covering portion 164*a*. For example, the thickness reduced region of the first covering portion 164*a* may be formed by removing the material of the surface, facing the non-orbiting scroll, of the first covering portion 164*a*. A predetermined gap can be formed between the first non-orbiting wrap portion 156*a* (or the sealing member) and the first covering portion 164*a* by the thickness reduced region of the first covering portion 164*a*, so that the issue of wear between the first non-orbiting wrap portion 156*a* (or the sealing member) and the first covering portion 164*a* can be avoided, and the oil seal can also be achieved. It should be understood that the thickness of the thickness reduced region may be constant (as shown in FIG. 8) or may be varied (as shown in FIG. 9).

The sealing device according to the present disclosure may be configured such that a gap G is formed between the sealing device and the first non-orbiting wrap portion 156*a* or between the sealing device and the first covering portion 164*a*. The gap G may be in a range of 0 μm to 30 μm so as to achieve an oil seal between the sealing device and the first non-orbiting wrap portion 156*a* or between the sealing device and the first covering portion 164*a* and to avoid the wear between the sealing device and the first non-orbiting wrap portion 156*a* or between the sealing device and the first covering portion 164*a*.

Furthermore, it can be appreciated that the protrusion or the sealing member may have an appropriate profile, shape or material so as to be able to mitigate or avoid the wear between the sealing member and the first non-orbiting wrap portion or between the sealing member and the first covering portion and/or facilitate the oil seal between them. In addition, the position, size and the like of the protrusion or sealing member may also be changed depending on the specific application requirements.

The above description and the examples shown in the drawings are for illustrative purposes only and are not intended to limit the present application. It should be understood that the individual features in one embodiment and the individual features in another embodiment described above may be combined with each other or interchanged. Additionally, a certain feature (or features) described in one embodiment may be omitted.

The present invention is particularly applicable to compressors having a non-orbiting scroll mounted in a fixed manner, for example, a compressor in which the non-orbiting scroll is fixedly connected to the main bearing housing. Structures for providing axial compliance (for example, structures including bolts and sleeves) can be dispensed in such a compressor, thus expanding the radial utilizable space of the scroll component, and thereby achieving a greater compressor capacity for a compressor having a housing with a given space (especially a given radial space). However, it should be understood that the present invention may be also applicable to other types of compressors, for example, compressors having axial compliance, compressors having a back pressure structure, compressors having no back pressure structures, compressors without a sealing washer provided in the wraps, etc.

While the various embodiments of the present disclosure have been described in detail herein, it is to be appreciated that the present application is not limited to the specific embodiments described and illustrated herein in detail, and other variations and modifications can be made by the person skilled in the art without departing from the spirit and scope of the present application. All the variations and modifications fall within the scope of the present disclosure. Moreover, all of the components described herein may be replaced by other technically equivalent components.

The invention claimed is:

1. A scroll compressor comprising:

a non-orbiting scroll comprising a non-orbiting scroll end plate and a spiral non-orbiting wrap extending from the non-orbiting scroll end plate; and an orbiting scroll comprising an orbiting scroll end plate and a spiral orbiting wrap extending from the orbiting scroll end plate and meshingly engaging with the non-orbiting wrap to form compression chambers, wherein the non-orbiting wrap comprises a first non-orbiting wrap portion at a radially outer side and a second non-orbiting wrap portion at a radially inner side, the first non-orbiting wrap portion is periodically covered by the orbiting scroll end plate during operation of the scroll compressor, the second non-orbiting wrap portion is always covered by the orbiting scroll end plate during operation of the scroll compressor, the orbiting scroll end plate comprises a first covering portion corresponding to the first non-orbiting wrap portion and a second covering portion corresponding to the second non-orbiting wrap portion, and a first sealing member is provided on a first end surface of the first non-orbiting wrap portion, wherein a first predetermined gap is formed between the first sealing member and the first covering portion, and a second sealing member is provided on a second end surface of the second non-orbiting wrap portion, wherein the first sealing member has a height less than a height of the second sealing member, and wherein a first groove is provided on the first end surface of the first non-orbiting wrap portion and configured to accommodate the first sealing member, and a second groove is provided on the second end surface of the second non-orbiting wrap portion and configured to accommodate the second sealing member.

2. The scroll compressor according to claim 1, wherein the second sealing member is continuous with the first sealing member or is separate from the first sealing member; and/or a difference between the height of the first sealing member and the height of the second sealing member is up to 100 um; and/or the height of at least one of the first sealing member and the second sealing member is constant or varied.

3. The scroll compressor according to claim 1, wherein the first groove is continuous with the second groove or is separate from the second groove; and/or a depth of at least one of the first groove and the second groove is constant or varied.

4. The scroll compressor according to claim 1, wherein an oil seal is achieved via the first predetermined gap between the first sealing member and the first covering portion.

5. The scroll compressor according to claim 1, wherein the first predetermined gap is up to 30 um.

6. A scroll compressor comprising:

a non-orbiting scroll comprising a non-orbiting scroll end plate and a spiral non-orbiting wrap extending from the non-orbiting scroll end plate; and an orbiting scroll comprising an orbiting scroll end plate and a spiral orbiting wrap extending from the orbiting scroll end plate and meshingly engaging with the non-orbiting wrap to form compression chambers, wherein the non-orbiting wrap comprises a first non-orbiting wrap portion at a radially outer side and a second non-orbiting wrap portion at a radially inner side, the first non-orbiting wrap portion is periodically covered by the orbiting scroll end plate during operation of the scroll compressor, the second non-orbiting wrap portion is always covered by the orbiting scroll end plate during operation of the scroll compressor, the orbiting scroll end plate comprises a first covering portion corresponding to the first non-orbiting wrap portion and a second covering portion corresponding to the second non-orbiting wrap portion, and a first sealing member is provided on a first end surface of the first non-orbiting wrap portion, wherein the first covering portion has a surface facing the non-orbiting scroll that is recessed relative to the second covering portion so that the first covering portion has a thickness less than a thickness of the second covering portion to form a first predetermined gap having a constant thickness between the first sealing member and the first covering portion via which an oil seal is formed during operation of the scroll compressor.

7. The scroll compressor according to claim 6, wherein the surface of the first covering portion is concaved relative to the second covering portion up to 100 μm.

8. The scroll compressor according to claim 6, wherein the oil seal is achieved via the first predetermined gap.

9. The scroll compressor according to claim 6, wherein the first predetermined gap is up to 30 μm.

* * * * *